US005924930A

United States Patent [19]

Stewart

[11] Patent Number: 5,924,930

[45] Date of Patent: Jul. 20, 1999

[54] HITTING STATION AND METHODS RELATED THERETO

[76] Inventor: Roger K. Stewart, 30726 Stweart Hollow Rd., Middleport, Ohio 45760

[21] Appl. No.: 08/832,494

[22] Filed: Apr. 3, 1997

[51] Int. Cl.[6] ..... A63B 69/40

[52] U.S. Cl. ..... 473/29

[58] Field of Search ..... 473/430, 422, 473/423, 424, 425, 426, 427, 428, 429, 417, FOR 108, FOR 109, FOR 460, FOR 197, FOR 213, 436, 437, 506, 507, 508, 431, 147, 148, FOR 160, FOR 214

[56] References Cited

U.S. PATENT DOCUMENTS

| | | | |
|---|---|---|---|
| 3,547,437 | 12/1970 | Anderson | 473/427 |
| 3,558,134 | 1/1971 | Hoitsma | 473/428 |
| 3,763,705 | 10/1973 | Gonzalez | 473/427 |
| 3,924,855 | 12/1975 | Pretorius | 473/428 |
| 3,948,517 | 4/1976 | Feiler | 473/429 |
| 3,953,028 | 4/1976 | Gowins | 473/428 |
| 4,664,375 | 5/1987 | Tetreault | 473/429 |
| 4,902,012 | 2/1990 | Kita | 473/428 |
| 4,944,513 | 7/1990 | Zentner | 473/428 |

*Primary Examiner*—Theatrice Brown
*Attorney, Agent, or Firm*—Robert N. Blackmon

[57] ABSTRACT

A multiple ball hitting station and a method related thereto are provided. The hitting station preferably has three balls, each movable and each being positioned along a common line. The station is useful for teaching and practicing a level swing, a down swing or an up swing, and helps the hitter to keep the hitter's lead shoulder in for a longer period of time, and provides the hitter with a wider view of the baseball swing area. The method provided involves providing the hitting station and having the batter hit all of the balls with the bat during a single swing.

1 Claim, 6 Drawing Sheets

HITTING STATION AND METHODS RELATED THERETO

BACKGROUND OF THE INVENTION

1. Field of the Invention

The present invention relates to hitting stations and methods related thereto, and more particularly relates to hitting stations for improving peripheral vision and methods related thereto.

2. Description of the Related Art

Conventional hitting stations utilizing a single ball are known, see for example Beimel U.S. Pat. No. 5,228,683 titled Baseball Batters Training Device issued Jul. 20, 1993. Such systems while providing some assistance in training batters to improve their hitting abilities, typically lack features suitable for improving the peripheral vision and bat movement patterns necessary to meet the desired results of professional hitting coaches. Historically, hitting (batting) coaches have recognized the need for developing procedures for improving the peripheral vision of batters in the game of baseball, and have also attempted to teach batters to hit through the ball with a planar motion so as to improve the batting results. Conventional single ball batting stations have generally lacked the features necessary to improve the peripheral vision of batters and to improve the planar hitting motion of the batters.

Consequently, there is a need and desire to provide a batting station and related method which improves the peripheral vision of the batter and improves the swing pattern of the batter.

SUMMARY OF THE INVENTION

The present invention involves a multiple ball hitting station and a method related thereto. The hitting station preferably has three balls, each movable and gravitationally biased such that the balls lie upon a common line when at rest. The station is useful for teaching and practicing a level swing, a down swing or an up swing, and helps the hitter to keep the hitter's lead shoulder in for a longer period of time, and provides the hitter with a wider view of the baseball swing area. The method provided involves providing the hitting station and having the batter hit all of the balls with the bat during a single swing.

DETAILED DESCRIPTION OF THE INVENTION

Figure 1:
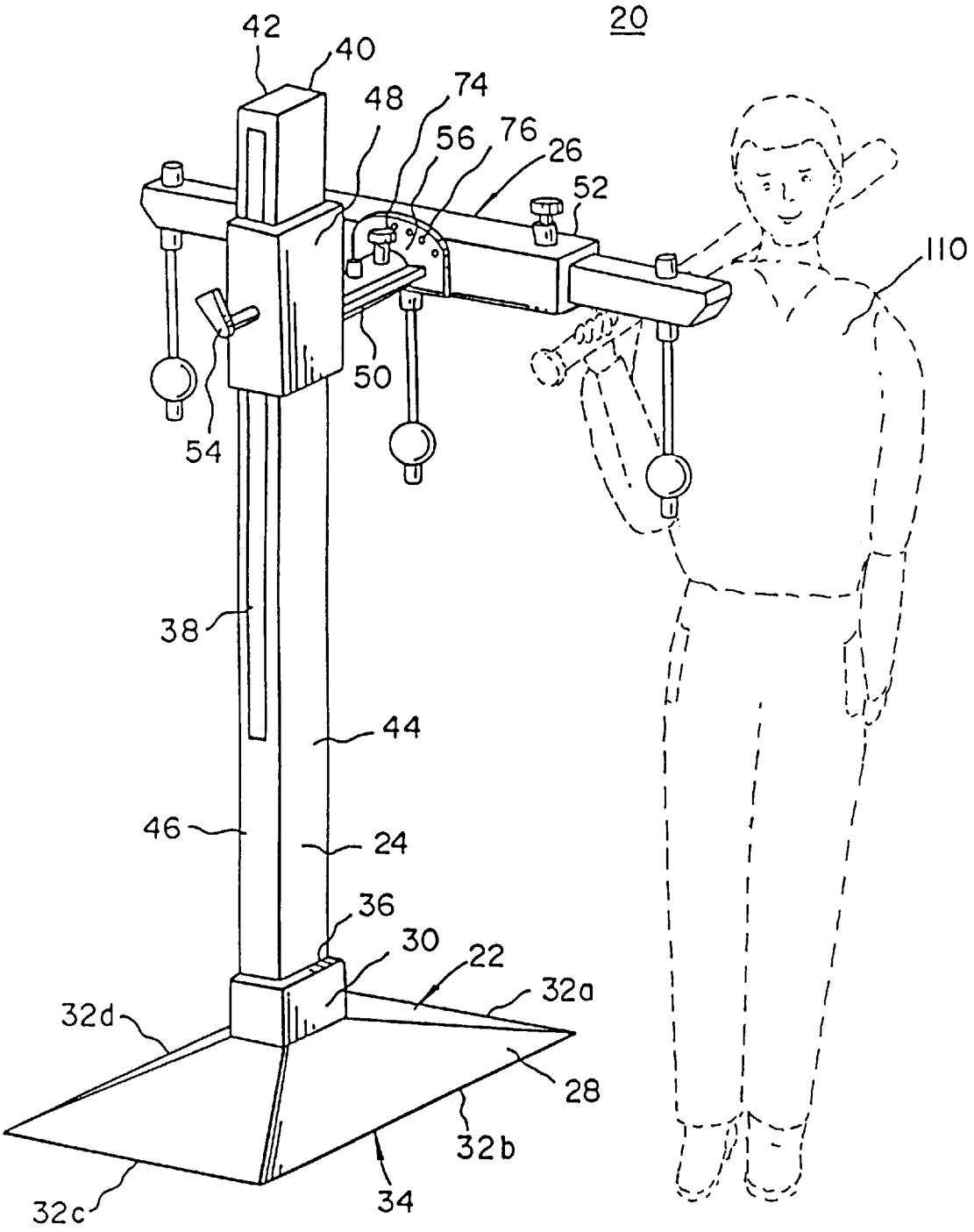
FIG. 1 is a perspective view of a hitting station according to the present invention.

As best shown in FIG. 1, the hitting station device (20) preferably comprises a base (22), a vertical support post (24) extending upwardly from the base (22), and a ball series unit (26) supported by the post (24) and movable vertically therealong.

The base (22) preferably has a base element (28) and a cup (30) located in the center of the base element (28). The base element (28) is preferably substantially rectangular in shape having four side edges (32 *a, b, c, d*) about its periphery (34). The base element (28) preferably extends inwardly and upwardly from the side edges (32 *a,b,c,d*) to the cup (30) which is located in the center of the element (28). The cup (30) preferably has a rectangular horizontal cross-section and is open at the top thereof (mouth (36)). Mouth (36) is rectangular in shape for receiving the bottom of the post (24).

Post (24) is received within cup (30) and extends vertically upward from base (22). The post (24) preferably is rectangular in horizontal cross-section. The post (24) has a series of teeth (38) for permitting the unit (26) to be locked in a vertical position along the post (24). The post (24) preferably has a front side (40), a left side (42), a right side (44) and a rear side (46). The teeth (38) preferably extend rearwardly from and are positioned vertically along the rear side (46) of the post (24).

The unit (26) comprises (a) a collar (48), (b) an extension arm (50) extending from the collar (48) and (c) a ball supporting device (52) attached to the arm (50). The collar (48) is movable vertically along the post (38) and may be locked in position relative thereto. For example, the collar (48) preferably has a spring loaded lock pin (54) which may be pulled rearwardly by the user to disengage the pin (54) from the teeth (38) and permit movement of the collar (48) along the post (24) and then may be released by the user to permit the pin (54) to reengage the teeth (38) and lock the collar (48) in position relative to the post (24).

The arm (50) extends between the collar (48) and the support device (52) and permits adjustment of the orientation of the support device (52). The arm (50) has a first pivot unit (54) which permits rotation about a vertical axis (55), and has a second pivot unit (56) which permits pivoting about a horizontal axis (57). The arm (50) has a first segment (58) which extends horizontally outwardly from and is rigidly attached to the collar (48). The first segment is preferably a flat horizontal piece. The arm (50) has a second segment (60) which comprises two horizontal vertically spaced apart plates (62, 64) attached positioned such that the first segment is between the plates (62, 64). A vertical pin (66) extends through the first and second segments and provides the vertical axis (55). A locking bolt (68) may be located on the second segment for preventing undesired movement the second segment relative to the first segment.

The second pivot axis (57) is provided by a pivot pin (70) which extends through the center of the support device (52) and into the outward end of the second segment. The second segment has a locking plate (72) which as a plurality of locking holes (74) for permitting locking of the relative position of the devise relative to the plate. A locking pin (76) may be extended through a respective hole (74) and into contact with the device (52) for locking the position of the device.

The support device (52) preferably has (a) a first center member (78) pivotable about the horizontal axis (57) (pin (70)), (b) a second extendable member (80) extending from one end of and telescopically received by the center member, and (c) a third extendable member (82) extending from another end of and telescopically received by the center member. The second and third members (80, 82) may be extended outward or moved inward to vary the effective width of the device. A first central ball (84) unit depends from the central member and is pivotally attached thereto, a second ball unit (86) depends from a outer portion of the second member and is pivotally attached thereto, and a third ball unit(88) depends from an outer portion of the third member and is pivotally attached thereto. Preferably the ball units are attached to their respective members by a ball and socket arrangement. The center ball unit (84) has a ball (90) attached to one end of a rod (92) and the rod (92) is has at another end a small ball bearing (not shown) which is received (captured) within a socket (94)of the center member. The second ball unit (86) also has a rod (96) which has a ball (98) attached to one end thereof and has a ball bearing (not shown) attached to another end thereof and received within a socket (100) of the second member (80). The third ball unit (88) also has a rod (102) which has a ball (104) attached to one end thereof and has a ball bearing (not shown) attached to another end thereof and received withing a socket (106) of the third member.

The rods (92, 96, 102) are preferably all the same length and all of the balls (90, 98, 104) lie along a common line (108) to provide the desired swing line for batting training.

Figure 3:
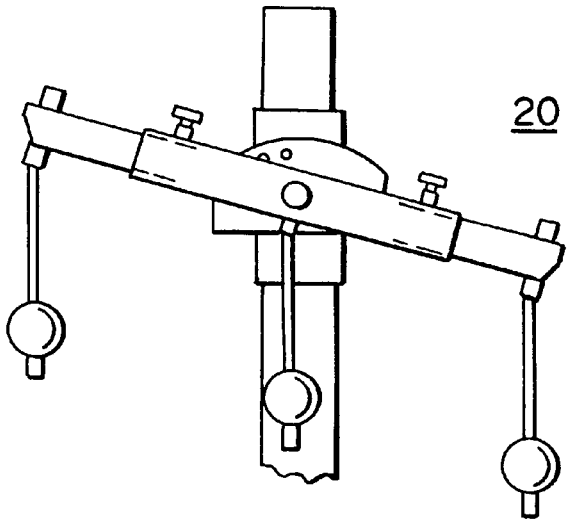
FIG. 3 is a cutaway front elevational view of the station of FIG. 1 in an upswing position.
Figure 2:
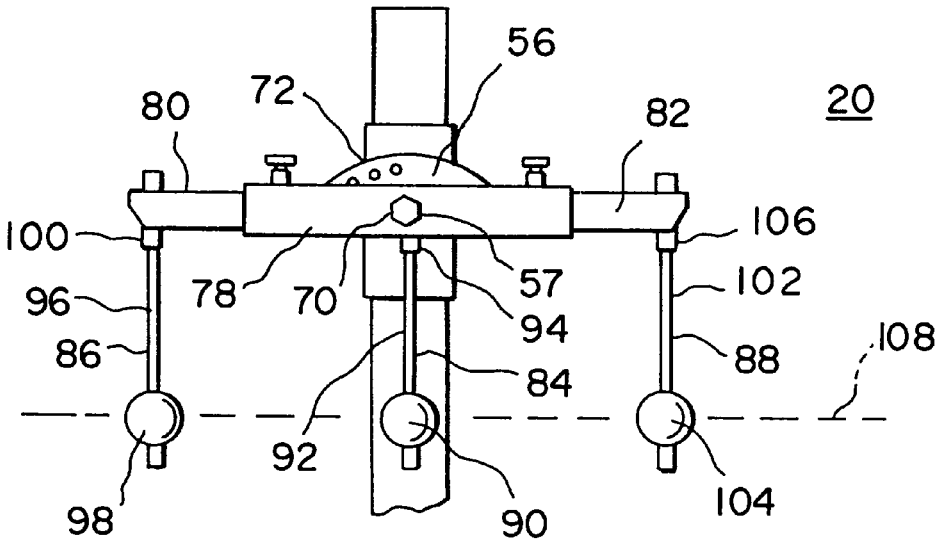
FIG. 2 is a cutaway front elevational view of the station of FIG. 1 in a line drive position.
Figure 4:
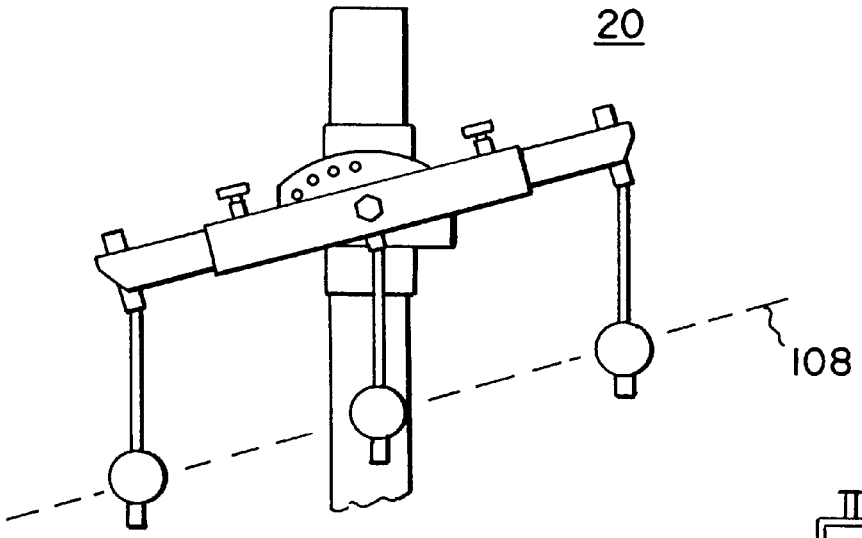
FIG. 4 is a cutaway front elevational view of the station of FIG. 1 in a down swing position.
Figure 6:
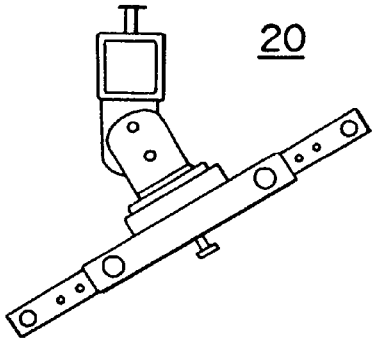
FIG. 6 is a top plan view of the station of FIG. 1 in a left field position.
Figure 5:
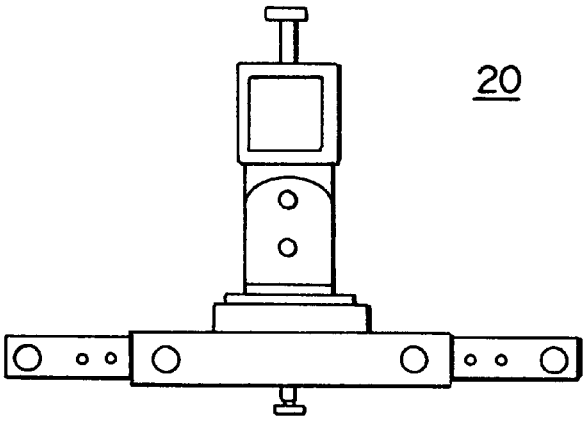
FIG. 5 is a top plan view of the station of FIG. 1 in a center field position.
Figure 7:
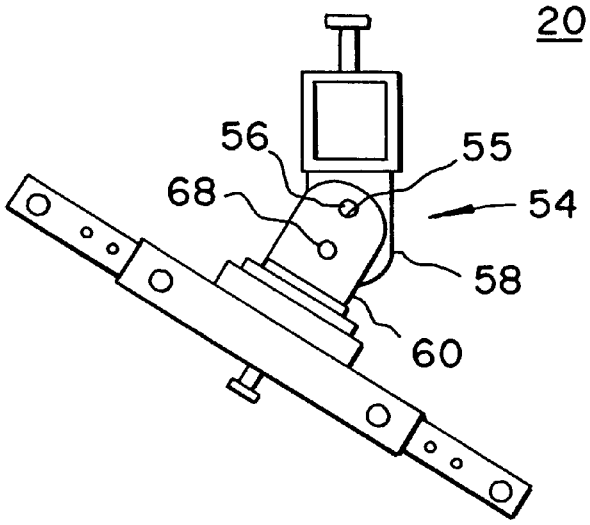
FIG. 7 is a top plan view of the station of FIG. 1 in a right field position.
Figure 8:
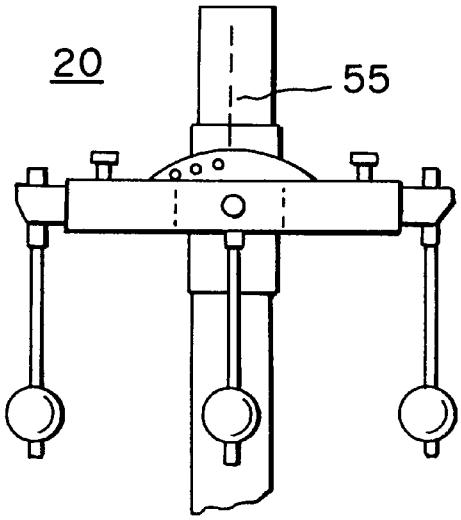
FIG. 8 is a cutaway front elevational view of the station of FIG. 1 in a reduced difficulty position.
Figure 9:
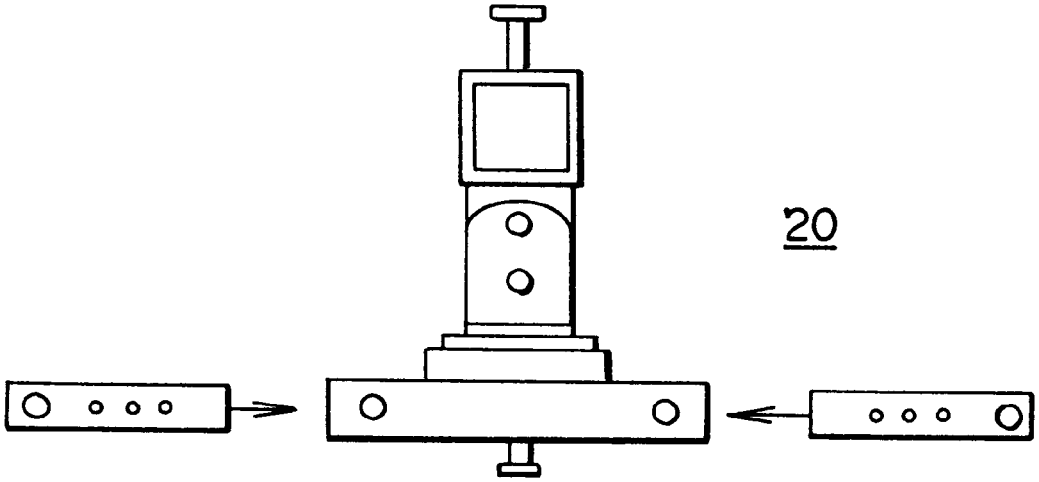
FIG. 9 is an exploded top plan view of an unit of the hitting station of FIG. 1.
Figure 10:
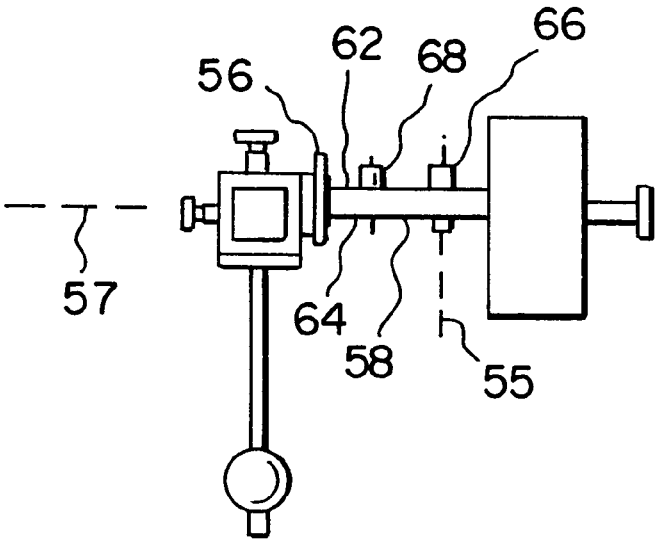
FIG. 10 is a side elevational view of the unit of the hitting station.
Figure 11:
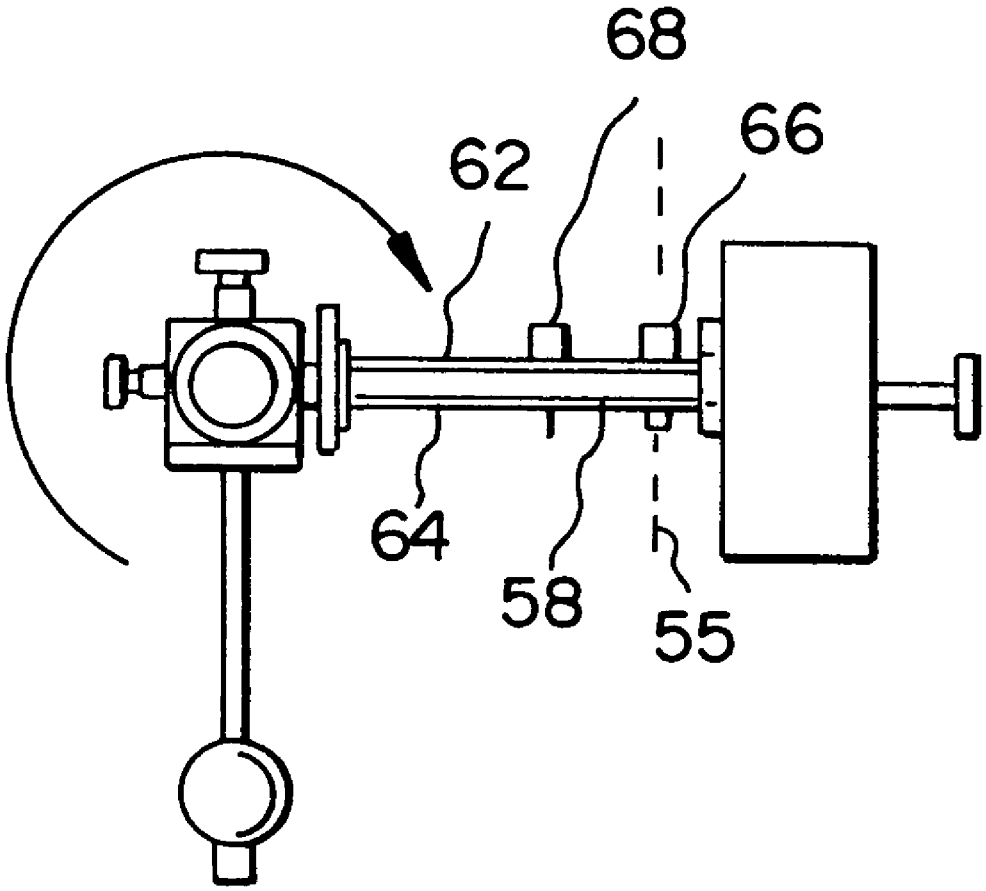
FIG. 11 is a side elevation view of an alternative embodiment of a unit having a swivel connection.

During use the batter (user) (110) stands in front of the station (20) and focuses his/her vision at the center ball (90) while swinging. The desired swinging motion will provide a linear swing through the line formed by the three balls (90, 98, 104) thereby hitting all three balls (90, 98, 104) during the single swinging motion. The user (110) may adjust the station between a plurality of positions to improve the swing motion of the user for a variety of desired hitting actions. By placing the station in such that the ball supporting device is oriented as shown in FIG. 6, the batter (110) can practice on hitting the balls for a left field hitting result. By position the device as shown in FIG. 5, the batter can practice on developing a swing for hitting a ball to center field, and by positioning the support as shown in FIG. 7, the batter (110) can practice on a swing for hitting the ball in center field. The positions of FIGS., 5, 6 and 7 can be selected by rotating the device about the vertical axis (55). Practicing various up swings, down swings and line drives can be done by changing the orientation of the devices about the horizontal axis (57). The up swing can be practiced in the orientation as show in FIG. 3, the down swing as shown in FIG. 4, and the line drive as shown in FIG. 2. Difficulty of the hitting can be varied as shown by figure B. The rods (92, 96, 102) may be encased in plastic, and optionally be replaced by a cord, but a cord will be less preferably for stability of the ball unit. The exploded view of FIG. 9, shows the insertion of the side members (80, 82) into the center member (78). FIG. 10 shows a side view of various element so of the hitting station (20). FIG. 11 shows an optional swivel connection for the station (20).

The present hitting training method for improving the swing of a baseball hitter, comprises (a) providing a hitting station having a plurality of balls, preferably three balls, positioned in a linear fashion (series of balls organized about a common line (lined up)) relative to each other, (b) swinging a bat through the balls to develop a linear swing. The method may also involve rotating (changing the orientation) the position of the balls to practice on various swinging motions for hitting a ball to left field, center field, right field, up swing, down swing and line drive.

What is claimed is:

1. A swing training device comprising:

(a) a central post having a vertical plane along its longitudinal direction and a horizontal plane orthogonal to said vertical plane;

(b) a plurality of arms extending outwardly from said post and rotatably connected to said post by a first pivot unit for selectively rotating said plurality of arms in said horizontal plane;

(c) a second pivot unit connected intermediate said post and said plurality of arms for selectively rotating said plurality of arms in said vertical plane; and (d) a plurality of balls, each pendulously suspended from a point on said support arms, said balls spaced apart from said support arms at a predetermined distance from said central post and gravitationally biased to lie along a common linear orientation at rest.

* * * * *